US008883390B1

(12) United States Patent
Tyagi et al.

(10) Patent No.: US 8,883,390 B1
(45) Date of Patent: Nov. 11, 2014

(54) METHOD FOR CREATING A SCRATCH-OFF DOCUMENT

(71) Applicants: Dinesh Tyagi, Fairport, NY (US); Mark Cameron Zaretsky, Rochester, NY (US); Robert David Bobo, Ontario, NY (US)

(72) Inventors: Dinesh Tyagi, Fairport, NY (US); Mark Cameron Zaretsky, Rochester, NY (US); Robert David Bobo, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 26 days.

(21) Appl. No.: 13/866,064

(22) Filed: Apr. 19, 2013

(51) Int. Cl.
*G03G 13/22* (2006.01)
*G03G 13/08* (2006.01)

(52) U.S. Cl.
CPC ..... *G03G 13/08* (2013.01)
USPC ..... 430/126.1

(58) Field of Classification Search
CPC ..... G03G 13/08
USPC ..... 430/126.1
See application file for complete search history.

(56) References Cited

U.S. PATENT DOCUMENTS

| | | | | |
|---|---|---|---|---|
| 8,342,576 | B2 | 1/2013 | Eschbach et al. | |
| 2007/0281224 | A1 * | 12/2007 | Kirk et al. | 430/18 |
| 2008/0131176 | A1 | 6/2008 | Snyder | |
| 2009/0263583 | A1 * | 10/2009 | Mantell et al. | 427/258 |
| 2014/0050903 | A1 * | 2/2014 | Lettow et al. | 428/201 |

FOREIGN PATENT DOCUMENTS

| | | | | |
|---|---|---|---|---|
| GB | 1214329 | * | 12/1970 | G03G 15/16 |

* cited by examiner

*Primary Examiner* — Peter Vajda
(74) *Attorney, Agent, or Firm* — Peyton C. Watkins

(57) ABSTRACT

A method for creating a scratch-off document having hidden information, the method includes providing a substrate; depositing a first layer of first toner particles on the substrate, wherein the first layer includes at least two thicknesses in which one region is thicker than the other region; depositing a second layer of toner particles on the first layer, wherein the first toner particles have a different thermal conductivity than the second toner particles; and applying heat to the first and second layers simultaneously so that the first layer adheres to the substrate in regions of the lesser thickness of the first toner particles and does not adhere in the regions of greater thickness of the first toner particles; wherein the first and second layers in the regions of greater thickness of the first toner layer can be removed thereby revealing hidden information.

16 Claims, 6 Drawing Sheets

METHOD FOR CREATING A SCRATCH-OFF DOCUMENT

CROSS REFERENCE TO RELATED APPLICATIONS

Reference is made to commonly assigned U.S. patent application Ser. No. 13/866,068 filed concurrently herewith by Zaretsky et al, entitled "A Scratch-Off Document Having Layers of Different Thermal Conductivity," the disclosures of which are herein incorporated by reference.

FIELD OF THE INVENTION

The present invention generally relates to scratch-off documents having at least two toner layers deposited on a substrate and more particularly to depositing the underlying toner layer directly on a substrate that includes one or more portions that are easily removed during scratch-off.

BACKGROUND OF THE INVENTION

Currently, scratch-off documents are used for a variety of applications. One of the most commonly used applications is the use of scratch-off documents for creating lottery tickets. In this application, a person purchases a lottery ticket and uses a hard object to scratch off the portion of the ticket covering hidden information such as a particular number. The use of scratch-off documents has vastly increased over the past years and several prior art documents address creating scratch-off documents.

In this regard, U.S. Patent Application 2007/0281224 is directed to a scratch-off document in which a first layer of toner forms an image and an optional barrier layer, typically clear, is deposited hereon. The first layer is well adhered to the substrate and the barrier layer is well adhered to the first layer. A second removable layer of toner is adhered to the first layer and can be removed when scratched using a hard object, leaving the first layer intact on the substrate. The application of the barrier layer is carried out offline and the document is reprinted with the scratch-off layer.

U.S. Patent Application 2008/0131176 is directed to an apparatus and method for producing a scratch-off document in which front side information containing the information to be hidden prior to scratch-off is first fused or otherwise adhered to the base material prior to the printing of a removable scratch-off layer.

U.S. Patent Application 2009/0263583 is directed to a scratch-off document in which the information layer includes both an indicia and a noise component of varying height. A scratch off layer is deposited over the noise component. This variable height functions to obscure the indicia so that it is not easily seen until scratched off.

U.S. Pat. No. 8,342,576 is directed to a scratch-off document having a first toner layer containing hidden information (i.e., the image that will eventually be revealed to the user after scratch off). The first layer is then covered by a printed, removable, waxy scratch-off layer having a distraction pattern.

Although each is satisfactory, cost efficiency improvements are always needed, as is the need for simple, but efficient scratch-off documents. In this regard, the prior art documents all use a plurality of fusing steps which is both costly and time consuming. The present invention overcomes these shortcomings by using two toner materials having different thermal conductivities so that only a single fixing step (or fusing step) is necessary.

SUMMARY OF THE INVENTION

The present invention is directed to overcoming one or more of the problems set forth above. Briefly summarized, according to one aspect of the invention, the invention resides in a method for creating a scratch-off document having hidden information, the method comprising: providing a substrate; depositing a first layer of toner particles on the substrate, wherein the first layer includes at least two thicknesses in which one region is thicker than the other region; depositing a second layer of toner particles on the first layer, wherein the first toner particles have a different thermal conductivity than the second toner particles; and applying heat to the first and second layers simultaneously so that the first layer adheres to the substrate in regions of the lesser thickness of the first toner particles and does not adhere in the regions of greater thickness of the first toner particles; wherein the first and second layers in the regions of greater thickness of the first toner layer can be removed thereby creating or revealing the hidden information.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, and wherein:

DETAILED DESCRIPTION OF THE INVENTION

Figure 1:
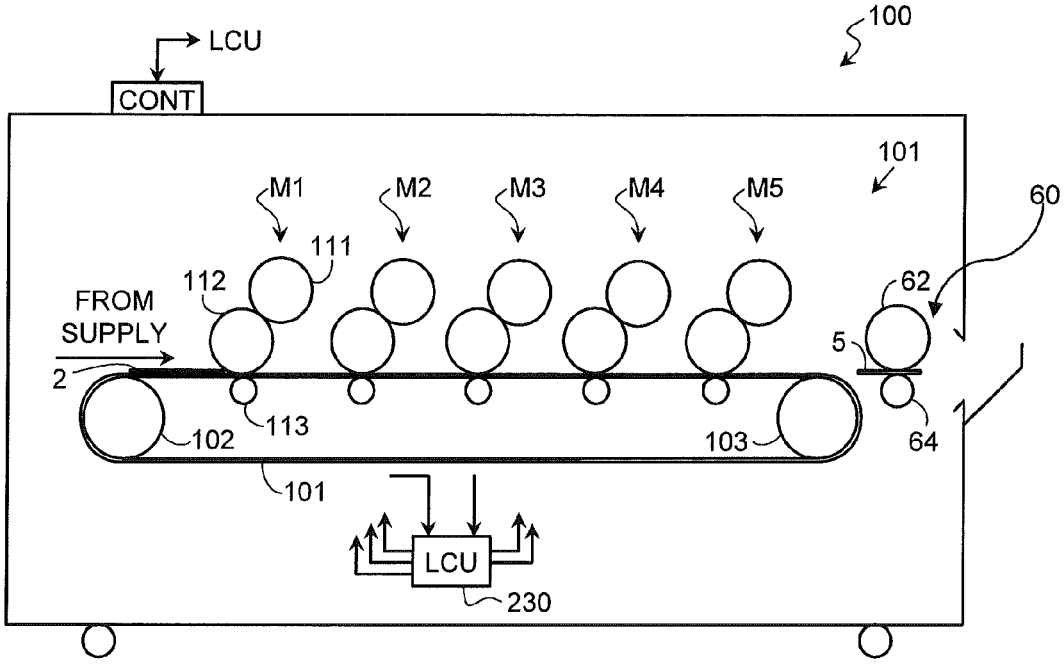
FIG. 1 is a schematic side elevational view, in cross section, of a typical electrophotographic reproduction apparatus (printer) suitable for use in the practice of the present invention.

Turning now to FIG. 1, a useful printing machine of the present invention is illustrated. FIG. 1 is a side elevational view schematically showing portions of a typical electrophotographic print engine or printer apparatus suitable for printing of one or more toner images. An electrophotographic printer apparatus 100 has a number of sequentially arranged electrophotographic image forming printing modules M1, M2, M3, M4, and M5. Each of the printing modules M1-M5 generates a single dry toner image for transfer to a receiver material successively moved through the modules M1-M5. Each receiver material, during a single pass through the five modules M1-M5, can have transferred in registration thereto up to five single toner images. A composite color toner image formed on a receiver material can comprise combinations or subsets of the CYMK color toner images and the black or dark colored polymeric toner particles described herein, on the receiver material over the composite color toner image on the receiver material. In a particular embodiment, printing module M1 forms black (K) toner color separation images, M2 forms yellow (Y) toner color separation images, M3 forms magenta (M) toner color separation images, and M4 forms cyan (C) toner color separation images. Printing module M5 can form a black or dark colored toner image that provides an opaque barrier hiding the information formed by the M1-M4 printing modules.

Receiver materials such as a substrate 2, as shown in FIG. 1, are delivered from a paper supply unit (not shown) and transported through the printing modules M1-M5. The receiver materials are adhered [for example electrostatically using coupled corona tack-down chargers (not shown)] to an endless transport web 101 entrained and driven about rollers 102 and 103.

Each of the printing modules M1-M5 includes a photoconductive imaging roller 111, an intermediate transfer roller 112, and a transfer backup roller 113, as is known in the art. For example, at printing module M1, a particular toner separation image can be created on the photoconductive imaging roller 111, transferred to intermediate transfer roller 112, and transferred again to the substrate 2 moving through a transfer station, which transfer station includes intermediate transfer roller 112 forming a pressure nip with a corresponding transfer backup roller 113.

The substrate 2 can sequentially pass through the printing modules M1 through M5. In some or all of the printing modules M1-M5 a toner separation image can be formed on the receiver material 5 to provide the desired scratch-off document comprising CMYK information hidden by an opaque toner layer. Printing apparatus 100 has a fuser of any well known construction, such as the shown fuser assembly 60 using fuser rollers 62 and 64 or nip-rollers at least one of which is heated. The substrate 2 of the present invention is preferably fused during one pass through the nip-rollers which is advantageous from a cost and time perspective.

A logic and control unit (LCU) 230 can include one or more processors and in response to signals from various sensors (CONT) associated with the electrophotographic printer apparatus 100 provides timing and control signals to the respective components to provide control of the various components and process control parameters of the apparatus as known in the art. In the present invention, the LCU 230 is used to vary the thickness of the toner deposited on the substrate 2 at predetermined portions, as will be described in more detail below.

Although not shown, the printer apparatus 100 can have a duplex path to allow feeding a receiver material having a fused toner image thereon back to printing modules M1 through M5. When such a duplex path is provided, two sided printing on the receiver material or multiple printing on the same side is possible.

Operation of the printing apparatus 100 will be described. Image data for writing by the printer apparatus 100 are received and can be processed by a raster image processor (RIP), which can include a color separation screen generator or generators. The image data include information to be formed on the receiver material, which information is also processed by the raster image processor. The output of the RIP can be stored in frame or line buffers for transmission of the color separation print data to each of the respective printing modules M1 through M5 for printing color separations in the desired order. The RIP or color separation screen generator can be a part of the printer apparatus or remote therefrom. Image data processed by the RIP can at least partially include data from a color document scanner, a digital camera, a computer, a memory or network. The image data typically include image data representing a continuous image that needs to be reprocessed into halftone image data in order to be adequately represented by the printer.

Figure 2:
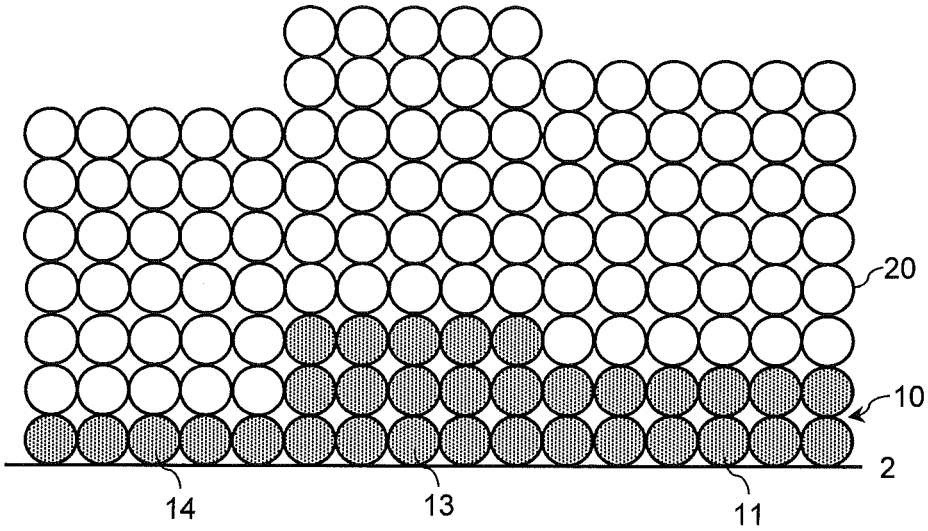
FIG. 2 is a side view in cross section illustrating a substrate having toner deposited thereon according to one embodiment of the present invention.

Referring to FIG. 2, there is shown a side view of a substrate 2 having a first toner layer 10 of varying thickness. The substrate 2 is preferably paper or any suitable printing media receptive to toner printing. The first toner layer 10 includes a first tier 13 having a first thickness and a second tier 11 having a second thickness in which the first thickness is greater than the second thickness. The first toner layer 10 also includes a third tier 14 having a third thickness that is less than the second tier 11. Although the second and third tiers 11, 14 are shown having different thicknesses, those skilled in the art will recognize that the second tier 11 and third tier 14 may be of equal height or their proportions may be reversed as long as the underlying use different thermal conductivities of materials is used, as described in detail below. It is noted that the first tier 13 is patterned in a predetermined shape that is representative of, but not limited to, symbols, numbers, letters and other symbols used in writing, art and the like. A second toner layer 20 is deposited on the first toner layer 10 uniformly in excess of 1.0 mg/cm$^2$.

Turning now to the details of the first and second layers 10 and 20, the first toner layer 10 and second toner layer 20 both include toner particles, and the first toner layer 10 includes first toner particles that comprise at least one pigment or at least one dye or a combination thereof. The second toner layer 20 is formed by second toner particles that have a significantly lower thermal conductivity as compared to the first toner particles. This is preferably accomplished by adding one or more suitable additives listed in Table 1. The first tier 13 of the first toner layer 10 is preferably applied at a mass lay-down of toner greater than or equal to 0.60 mg/cm$^2$. The second toner layer 20 is deposited on the first toner layer 10 uniformly in excess of 1.0 mg/cm$^2$. The difference in thermal conductivity and mass laydown of the first toner layer 10 and second layer 20 makes the first tier 13 and the toner layer 20 in registration with the first tier 13 less adhesive to the substrate 2. This permits it to be scratched off using a fingernail, a hard rigid object or any object suitable for scratch off after fusing the first layer 10 and second layer 20 to the substrate 2.

The thermal conductivity of the second toner particles of second toner layer 20 may be less than or equal to 90% of, preferably less than or equal to 70% of, the thermal conductivity of the first toner particles of first toner layer 10 so that first toner layer 10 melts more readily than second toner layer 20. The maximum mass laydown for toner layer 10 for achieving good adhesion to substrate 2 when overcoated with second toner layer 20, will be a function of the thermal conductivities of the toners used for first and second toner layer (10 and 20 respectively) as well as the thickness of second toner layer 20 and the relevant fusing process conditions, e.g. operating temperature and nip dwell time for a set of nipped, heated fusing rollers. This maximum mass laydown functional dependence may be determined empirically using various methodologies including one as follows: for first and second toners having different thermal conductivities, a full factorial set of test patches are printed using a series of mass laydowns for both first and second toner layers (10 and 20 respectively) ranging from low to high levels for various combinations of fusing process condition setpoints. The patches are then tested for scratch-off so as determine the maximum mass laydown of first toner layer 10 as a function of the ratio of first and second toner thermal conductivity, second toner layer 20 mass laydown, and fusing process condition setpoints. This information may be stored in LCU 230 in the form of a lookup table (LUT) enabling determination of acceptable toner laydown for each of the tiers so as to provide the scratch-off capability. The maximum mass laydown functional dependence is used to determine the maximum mass laydown allowable for second and third tiers 11 and 14 for a given mass laydown of second toner layer 20 so as to have good adhesion to substrate 2. First tier 13 is then given a mass laydown in excess of this maximum, again for a given mass laydown of second toner layer 20, so as to have poor adhesion to substrate 2 and therefore enable the scratch-off functionality.

Toner particles having a lower thermal conductivity can be prepared by the direct addition of low thermal conductivity additives in the toner formulation during the melt compounding process or during the formation of the toner particles via chemical methods such as Limited Coalescence, Emulsion Aggregation (EA) or Suspension Polymerization. The reduced thermal conductivity materials can be solid or can be present inside the toner in the form of holes or pores. It is also possible to use toner additives having a flat platelet-like structure with the thermal conductivity in the normal direction of the plate being at least 5 times lower than the thermal conductivity in the planar direction of the flakes. One example of such a material is natural mica having a thermal conductivity in the planar direction 10 times higher than the thermal conductivity in the normal direction. There are many other low thermal conductivity materials that can be incorporated in the first or second toner particles. A partial list of some of these low thermal conductivity materials is summarized in Table 1. One experienced in this field would recognize that many other types of low thermal conductivity additives can be used for this purpose. There is a strong inter-relationship between the additive type (thermal conductivity), additive loading by weight amount, and fusing conditions (for example, fusing temperature and dwell time). The loading of these additives into a toner formulation typically range from 10% to 40% by weight. For comparison purposes, the thermal conductivity of binders used in toner compositions typically range from 0.30 to 0.70 W/(m-° K) and more commonly between 0.4 to 0.5 W/(m-° K).

TABLE 1

Thermal Conductivity k units of W/(m-° K)

| Material/Substance | Temperature - (25° C.) |
|---|---|
| Air, atmosphere (gas) | 0.024 |
| Calcium silicate | 0.05 |
| Carbon | 1.7 |
| Clay, dry to moist | 0.15-1.8 |
| Diatomaceous earth (Sil-o-cel) | 0.06 |
| Diatomite | 0.12 |
| Fiberglass | 0.04 |
| Foam glass | 0.045 |
| Magnesia insulation (85%) | 0.07 |
| Mica (perpendicular to cleavage planes) | 0.31 |
| Mica (parallel to cleavage planes) | 3.05 |
| Nylon 6 | 0.25 |
| Paraffin Wax | 0.25 |
| Polypropylene | 0.1-0.22 |
| Polystyrene, expanded | 0.03 |

TABLE 1-continued

Thermal Conductivity k units of W/(m-° K)

| Material/Substance | Temperature - (25° C.) |
|---|---|
| Polystyrol | 0.043 |
| Polyurethane foam | 0.03 |
| PTFE | 0.25 |
| PVC | 0.19 |
| Rubber, natural | 0.13 |
| Sand, dry | 0.15-0.25 |
| Silica aerogel | 0.02 |
| Urethane foam | 0.021 |
| Vermiculite | 0.058 |

Figure 3:
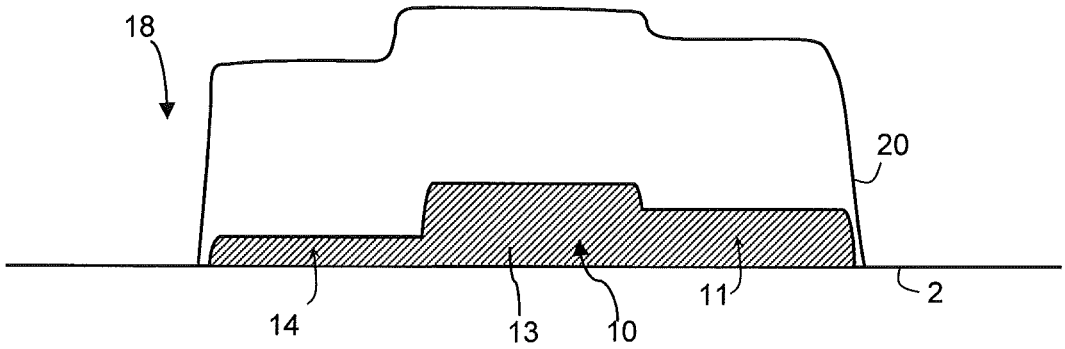
FIG. 3 is a view of FIG. 2 after the toner is fused to the substrate for creating a scratch-off document.
Figure 4:
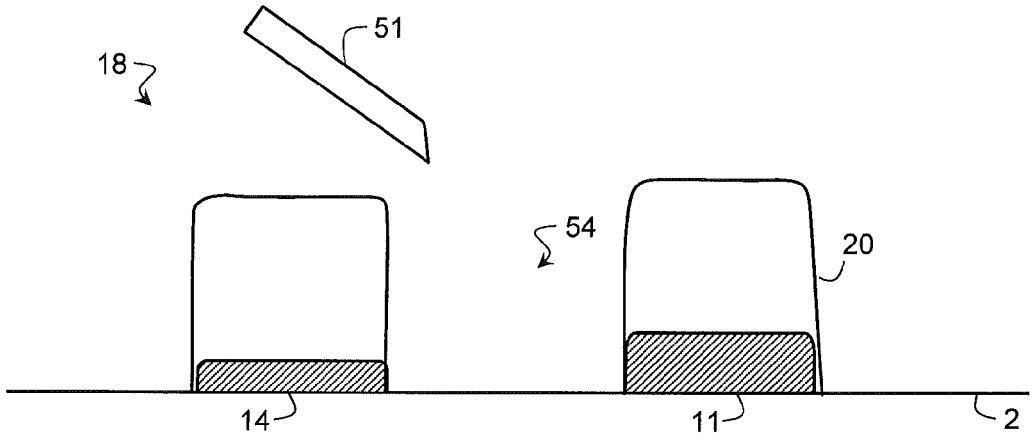
FIG. 4 is a view of FIG. 4 illustrating a portion of the toner being removed for revealing hidden information, cut through line 4-4 of FIG. 6.

Referring to FIG. 3, after depositing the first toner layer 10 and second toner layer 20 as described above, the substrate 2 with the first toner layer 10 and second toner layer 20 thereon are passed simultaneously through the fusing assembly 60 (see FIG. 1) which uses heat to fuse the first toner layer 10 and the second toner layer 20 as shown in FIG. 3. The fused first toner layer 10 and fused second toner layer 20 together form a toner covering, and the toner covering and the substrate 2 form a scratch-off document 18. The heat is sufficient to adhesively fuse the second tier 11 and third tier 14 to the substrate 2, but the first tier 13 is non-adhesively fused at a level which permits it to stay intact under normal conditions but to be removable by any rigid or semi-rigid scratch-off tool 51, such as coins, fingernails, keys and the like, in a scratching action as shown in FIG. 4. It is noted that the second toner layer 20 that is in registration with the first tier 13 (FIG. 3) is also removed with the first tier 13, but the second layer 20 in registration with the second tier 11 and third tier 14 is left intact.

It is also noted that the height difference as shown FIG. 3 could possibly reveal the contour of the hidden information prior to scratch-off. However, in practical terms this height difference is on the order of a few micrometers, a small difference that would not be discernible to the unaided eye or fingertip. Furthermore, many of the additives used to alter the thermal conductivity of the toner, as for example mica flakes, will impart a roughness to the surface that further hides any small difference in height. This surface roughness can also be achieved using a separate additive from that used to alter the thermal conductivity.

After scratching off the first tier 13 (FIG. 3), exposed region 54 is left which forms the one or more desired shapes (hidden information now revealed so that it is visible). It is noted that the substrate 2 is of a contrasting color to permit the visible images to be seen, as those in the art will readily recognize. The second toner layer 20 that is in registration with second tier 11 remains intact after scratch-off. When the heat is applied from above the second toner layer 20, the lower thermal conductivity reduces the temperature that can be achieved at the toner-substrate interface. In order to get adequate adhesion, it is imperative that a minimum substrate temperature is attained. Wherever the combined thickness of first toner layer 10 and second toner layer 20 is sufficiently high enough to prevent achieving the necessary temperature for toner-to-substrate adhesion, low adhesion quality to the substrate 2 is achieved. Therefore it would be possible to remove those areas which have poor fusing quality as determined by the combined amount of first toner layer 10 and second toner layer 20.

It is noted for clarity that the first toner layer 10 and second toner layer 20 are deposited as described above by having the LCU 230 (See FIG. 1) vary its toner depositing using any printing module M1-M5 individually or in any combination to produce the heights as described above. In other words, each of the first and second toner layers 10 and 20, may be made of one toner color or a plurality of toner colors with its height deposition varied accordingly, as those skilled in art will readily recognize.

In an alternative embodiment, also represented by FIGS. 2 and 3, first toner layer 10 is formed from first toner particles having a lower thermal conductivity than second toner particles used to form second toner layer 20. This is accomplished by adding one or more suitable additives listed in Table in the first toner particles. The first toner layer 10 has the lower thermal conductivity and is removable in regions where the mass lay-down of the first toner layer 10 is in excess of 1.0 mg/cm$^2$. In this case, first tier 13 will still be poorly adhered to substrate 2, relative to the adhesion of second or third tiers 11 or 14 to substrate 2, because of the higher mass laydown of the lower thermal conductivity first toner particles. The thermal conductivity of the first toner particles of first toner layer 10 may be less than or equal to 90% of, preferably less than or equal to 70% of, the thermal conductivity of the second toner particles of second toner layer 20 so that the first toner layer 10 melts less readily than second toner layer 20. The maximum mass laydown for first toner layer 10 for achieving good adhesion to substrate 2 when overcoated with second toner layer 20, will be a function of the thermal conductivities of the toners used for first and second toner layer (10 and 20 respectively) as well as the thickness of second toner layer 20 and the relevant fusing process conditions, e.g. operating temperature and nip dwell time for a set of nipped, heated fusing rollers. This maximum mass laydown functional dependence may be determined empirically using various methodologies including one as follows: for first and second toners having different thermal conductivities, a full factorial set of test patches are printed using a series of mass laydowns for both first and second toner layers (10 and 20 respectively) ranging from low to high levels for various combinations of fusing process condition setpoints. The patches are then tested for scratch-off so as to determine the maximum mass laydown of first toner layer 10 as a function of the ratio of first and second toner thermal conductivity, second toner layer 20 mass laydown, and fusing process condition setpoints. This information may be stored in LCU 230 in the form of a lookup table (LUT) enabling determination of acceptable toner laydown for each of the tiers so as to provide the scratch-off capability. The maximum mass laydown functional dependence is used to determine the maximum mass laydown allowable for second and third tiers 11 and 14 for a given mass laydown of second toner layer 20 so as to have good adhesion to substrate 2. First tier 13 is then given a mass laydown in excess of this maximum, again for a given mass laydown of second toner layer 20, so as to have poor adhesion to substrate 2 and therefore enable the scratch-off functionality.

Figure 5:
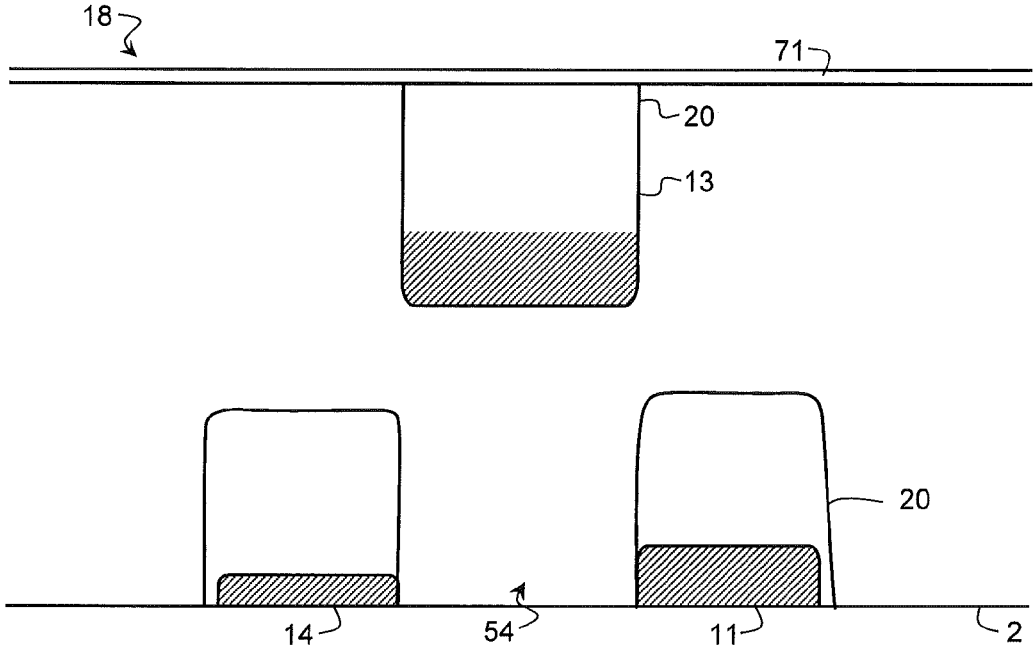
FIG. 5 is an alternative embodiment of FIG. 4.

Referring to FIG. 5, there is shown an alternative embodiment for removing the first tier 13 and the portion of the second toner layer 20 in registration with the first tier 13. In this embodiment, an adhesive tape 71 is applied to the surface of the second toner layer 20 and then the adhesive tape 71 is pulled off either manually or by any suitable tool. This adhesive pulling force causes the first tier 13, and the portion of the second toner layer 20 in registration with the first tier 13, to be removed with the adhesive tape 71 leaving the exposed region 54 that forms the desired shape. Again the second tier 11 and third tier 14 and the portion of the second toner layer 20 in registration with the second tier 11 and third tier 14 are left intact.

Figure 6:
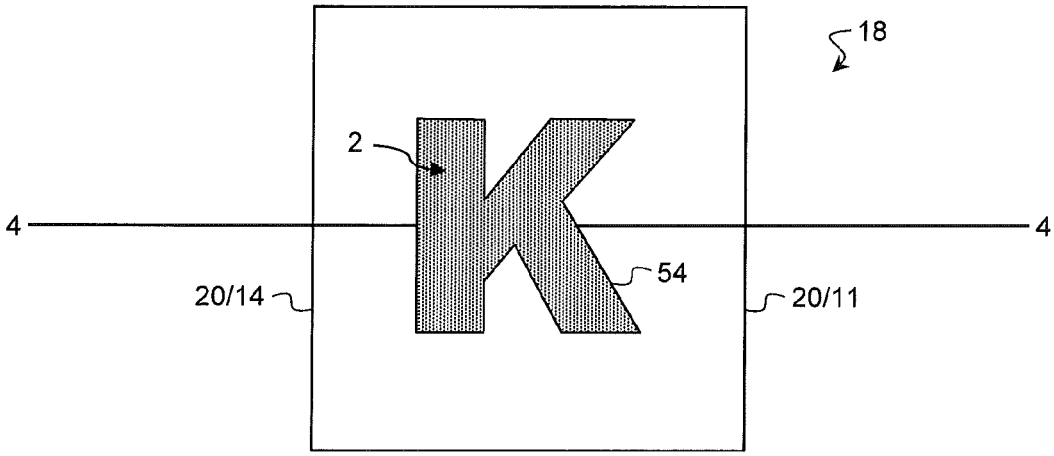
FIG. 6 is a top view of FIG. 4 with the scratch off tool removed from view for illustrating the hidden information, the letter "K" in this example.

Referring to FIG. 6, there is shown a top view of FIG. 3 with the scratch-off tool 51 removed so that the scratch-off document 18 can be seen more clearly. In this example, the letter "K" is formed from the exposed region 54, and the second tier portion 11 and third tier portion 14 and the portion of the second layer 20 in registration with the second tier (denoted 20/11 in FIG. 5) and third tier portion (denoted 20/14 in FIG. 5) both remain intact after scratch-off and form the background.

Figure 7:
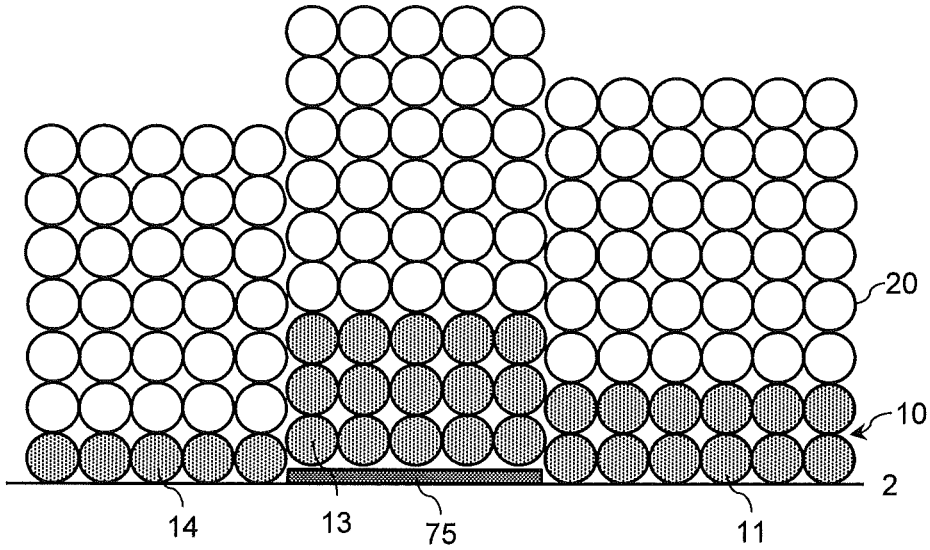
FIG. 7 is an alternative embodiment of FIG. 2 having an indicia image printed on the substrate before depositing the first and second toner layers.

Referring to FIG. 7, there is shown an alternative embodiment, in this embodiment an indicia image 75 is printed and fixed on the substrate 2 before applying the first toner layer 10, and the first tier 13 is in registration with the printed indicia image 75. For this embodiment, the second toner layer 20 contains the lower thermal conductivity second toner particles due to the addition of one or more suitable additives and is removable in regions where the mass lay-down of the second toner layer 20 is in excess of 1.0 mg/cm$^2$ and the mass laydown of the first toner layer 10 is in excess of 0.60 mg/cm$^2$. After scratch-off or adhesive pull off, the indicia image 75 is then visible as the desired shape. Again, the first tier 13, and the portion of the second toner layer 20 in registration with the first tier 13, can be removed leaving the exposed region 54 that forms the desired shape as shown in FIG. 4 or 5. The indicia image 75 and the layers are deposited in this configuration by programming the LCU 230 accordingly.

In another embodiment of the indicia image 75, the indicia image 75 is printed and fixed on the substrate 2 before applying the first toner layer 10, and the first tier 13 is in registration with the printed indicia image 75 as before. However, in this embodiment, the first toner layer 10 is rendered more thermally insulating by the addition of one or more suitable additives into the first toner particles. For this case, first tier 13 is deposited in excess of 1.0 mg/cm$^2$ in order to be removable.

Figure 8:
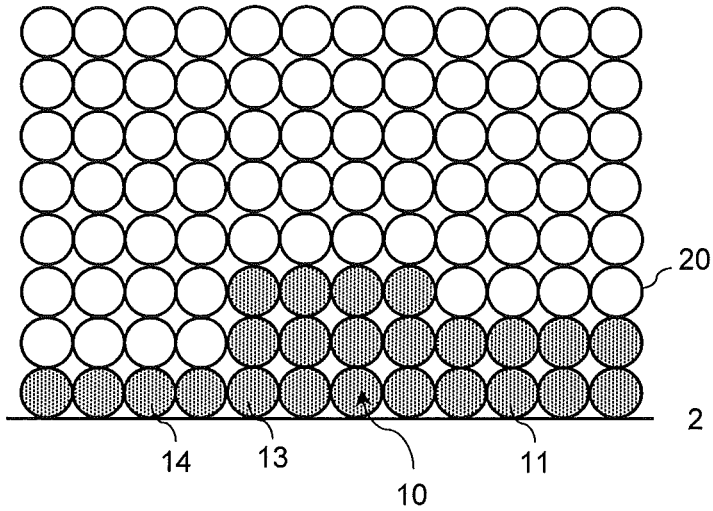
FIG. 8 is another alternative embodiment of FIG. 2 having the second toner layer deposited as an inverse mask of the first toner layer.

Referring to FIG. 8, in an alternative embodiment to a uniform laydown, the second toner layer 20 is deposited on the first toner layer 10 in an inverse mask in which the second toner layer 20 is in inverse proportion to the first toner layer 10. In other words, the second toner layer 20 includes a thicker region where the first layer 10 has a thinner region (second thickness), and the second toner layer 20 includes a thinner region where the first toner layer 10 has a thicker region (first thickness). The second toner layer 20 is layered in inverse proportion so that the combined thickness of the first toner layer 10 and the second toner layer 20 has a uniform thickness, preferably in excess of 1.70 mg/cm$^2$, and so that an outer surface of the second toner layer 20 is smooth or substantially smooth. For the case where the second toner layer 20 is formed by second toner particles having a significantly lower thermal conductivity as compared to the first toner particles the removable portions will be those having the thicker second toner layer 20 and the thinner first toner layer 10. Preferably, the removable portions will be those where the second toner layer 20 exceeds 1.0 mg/cm$^2$. For example, in FIG. 8, the second toner layer 20 exceeds 1.0 mg/cm$^2$ for the regions overlying second and third tiers 11 and 14 but is less than 1.0 mg/cm$^2$ for the region overlying first tier 13. Therefore, the removable portions are the regions defined by second and third tiers 11 and 14. The thermal conductivity of the second toner particles of second toner layer 20 may be less than or equal to 90% of, preferably less than or equal to 70% of, the thermal conductivity of the first toner particles of first toner layer 10 so that first toner layer 10 melts more readily than second toner layer 20. The first and second toner layers 10 and 20 are deposited in this configuration by programming the LCU 230 according.

Figure 9:
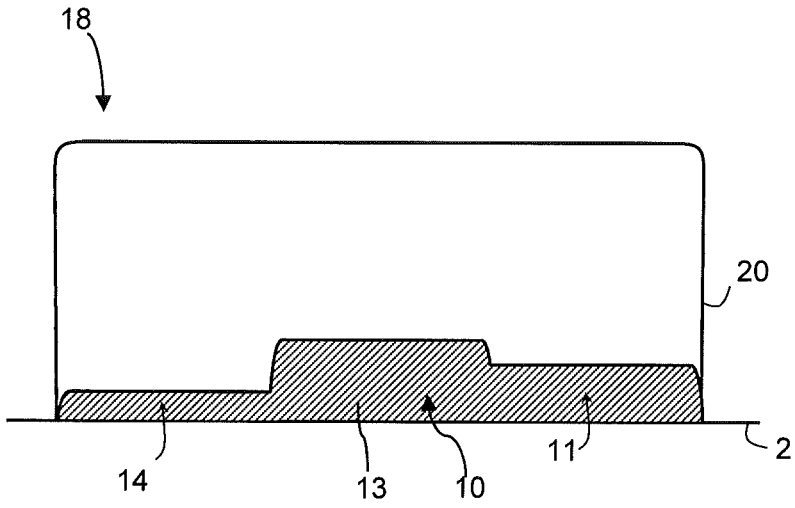
FIG. 9 is a view of FIG. 8 after the toner is fused to the substrate for creating a scratch-off document.
Figure 10:
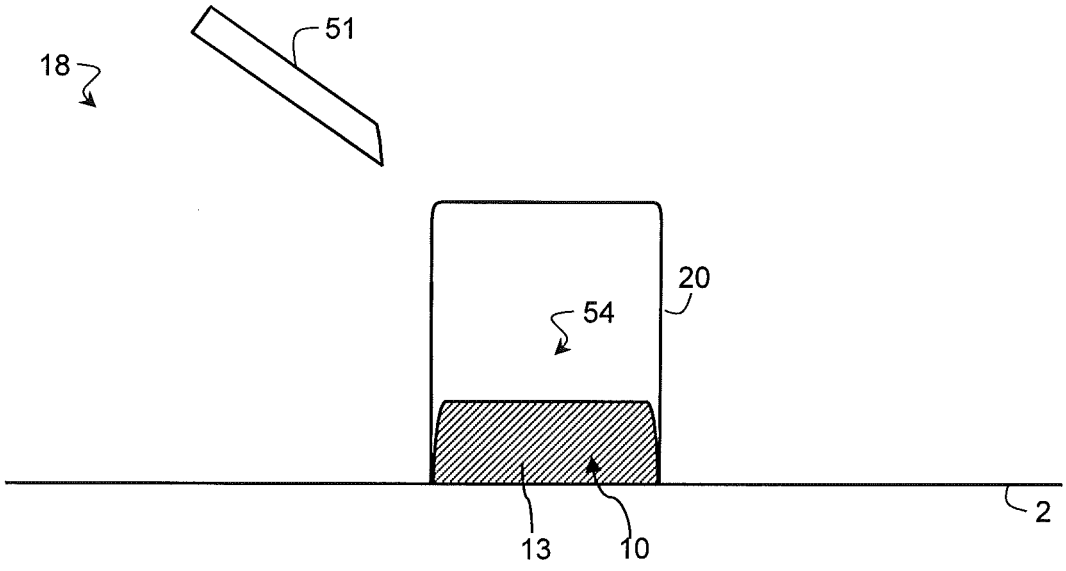
FIG. 10 is a view of FIG. 9 illustrating a portion of the toner being removed for revealing hidden information.

FIG. 9 shows the results of passing the toner deposition pattern of FIG. 8 through the fusing assembly 60 (see FIG. 1). The fused first toner layer 10 and fused second toner layer 20 together form a toner covering, and the toner covering and the substrate 2 form a scratch-off document 18. For this case, the heat is sufficient to adhesively fuse the first tier 13 to the substrate 2, but the second and third tiers, 11 and 14, are non-adhesively fused at a level which permits it to stay intact under normal conditions but to be removable by any rigid or semi-rigid scratch-off tool. FIG. 10 shows the results after scratching the document provided by this embodiment utilizing an inverse mask laydown of the second toner layer 20.

Another embodiment utilizing an inverse mask laydown of the second toner layer 20 is the case where the first toner layer 10 is formed by first toner particles having a significantly lower thermal conductivity as compared to the second toner particles, and the second toner layer 20 is deposited on the first toner layer 10 in an inverse mask in which the second toner layer 20 is in inverse proportion to the first toner layer 10, then the removable portions will be those having the thicker first toner layer 10, preferably in excess of 1.0 mg/cm$^2$, and therefore, the thinner second toner layer 20. For example, referring again to FIG. 8, but for this case where the first toner particles are significantly lower thermal conductivity as compared to the second toner particles, the first toner layer 10 exceeds 1.0 mg/cm$^2$ for first tier 13 but is less than 1.0 mg/cm$^2$ for second and third tiers 11 and 14. Therefore, the removable portion is the region defined by first tier 13. The thermal conductivity of the first toner particles of first toner layer 10 may be less than or equal to 90% of, preferably less than or equal to 70% of, the thermal conductivity of the second toner particles of second toner layer 20 so that the first toner layer 10 melts less readily than second toner layer 20.

In yet another embodiment, an indicia image 75 (as shown in FIG. 7 is applied to the embodiment of FIG. 8 but not shown in FIG. 8) is printed and fixed on the substrate 2 before applying the first toner layer 10 and the second toner layer 20 is deposited on the first toner layer 10 in an inverse mask in which the second toner layer 20 is in inverse proportion to the first toner layer 10. In this embodiment, the second toner layer 20 contains the lower thermal conductivity second toner particles due to the addition of one or more suitable additives and is removable in regions where the mass lay-down of the second toner layer 20 is in excess of 1.0 mg/cm$^2$.

In yet another embodiment, an indicia image 75 (as shown in FIG. 7 is applied to the embodiment of FIG. 8 bit not shown in FIG. 8) is printed and fixed on the substrate 2 before applying the first toner layer 10 and the second toner layer 20 is deposited on the first toner layer 10 in an inverse mask in which the second toner layer 20 is in inverse proportion to the first toner layer 10. In this embodiment, the first toner layer 10 contains the lower thermal conductivity first toner particles due to the addition of one or more suitable additives and is removable in regions where the mass lay-down of the first toner layer 10 is in excess of 1.0 mg/cm$^2$.

Uniform toner patches were prepared on a NexPress SE3000 Digital Color Production Press using standard CYMK toners in printing modules M1-M4 and a toner with reduced thermal conductivity additive in Printing Module M5. Prints were made on a Sterling Ultra Digital Gloss coated paper (118 gsm) at a speed of 83 ppm, fusing at a temperature of 163° C. and a dwell time of 0.050 sec. Color patches of various mass laydowns using the standard toners in printing modules M1-M4 were deposited and fused and subsequently tested for scratch off. For comparison, color patches of various mass laydowns using the standard toners in printing modules M1-M4 were deposited with various mass laydowns of the inventive toner deposited over the color patches and fused simultaneously. The composite images were again tested for scratch-off performance. The scratch-off results for the images are summarized below in Table 2.

TABLE 2

| Toner Layer 10 Mass Laydown (mg/cm$^2$) | Toner Layer 20 Mass Laydown (mg/cm$^2$) | Total Toner Mass Laydown (mg/cm$^2$) | Fused Area Scratch-Off Performance |
|---|---|---|---|
| 0.15 | 0.00 | 0.15 | No Scratch-Off |
| 0.30 | 0.00 | 0.30 | No Scratch-Off |
| 0.60 | 0.00 | 0.60 | No Scratch-Off |
| 1.10 | 0.00 | 1.10 | No Scratch-Off |
| 0.00 | 0.60 | 0.60 | No Scratch-Off |
| 0.15 | 0.60 | 0.75 | No Scratch-Off |
| 0.30 | 0.60 | 0.90 | No Scratch-Off |
| 0.60 | 0.60 | 1.20 | No Scratch-Off |
| 1.10 | 0.60 | 1.70 | No Scratch-Off |
| 0.00 | 1.10 | 1.10 | No Scratch-Off |
| 0.15 | 1.10 | 1.25 | No Scratch-Off |
| 0.30 | 1.10 | 1.40 | No Scratch-Off |
| 0.60 | 1.10 | 1.70 | Scratch-Off |
| 1.10 | 1.10 | 2.20 | Scratch-Off |

The results in Table 2 show that when first toner layer 10 is greater than or equal to 0.60 mg/cm$^2$ and the second toner layer exceeds 0.60 mg/cm$^2$, preferably exceeding 1.0 mg/cm$^2$, the image can be removed easily using various techniques. However, when either first toner layer 10 or second toner layer 20 fails to meet the minimum mass laydown requirements, the image was found to be well fused and could not be scratched off or easily removed by other means.

The present invention has been described in detail with particular reference to certain preferred embodiments thereof, but it will be understood that variations and modifications can be effected within the spirit and scope of the invention.

PARTS LIST

2 substrate
5 Receiver Material
10 first toner layer
11 second tier
13 first tier
14 third tier
18 scratch-off document
20 second toner layer
51 scratch-off tool
54 exposed region
60 fusing assembly
62 roller
64 roller
71 adhesive tape
75 indicia image
100 printing apparatus
101 transfer web
102 rollers
103 rollers
111 imaging rollers
112 intermediate transfer rollers
113 transfer backup rollers
230 logic and control unit (LCU)
M1-M5 Printing Modules

The invention claimed is:

1. A method for creating a scratch-off document having hidden information, the method comprising:

providing a substrate;

depositing a first layer of first toner particles on the substrate, wherein the first layer includes at least two thicknesses in which one region is thicker than the other region;

depositing a second layer of second toner particles on the first layer, wherein the first toner particles have a different thermal conductivity than the second toner particles; and applying heat to the first and second layers simultaneously so that the first layer adheres to the substrate in regions of the lesser thickness of the first toner particles and does not adhere in the regions of greater thickness of the first toner particles; wherein the first and second layers in the regions of greater thickness of the first toner layer can be removed thereby revealing the hidden information.

2. The method as in claim 1, wherein the second toner particles are optically opaque.

3. The method as in claim 1, wherein the first layer has the thicker region applied at a mass lay-down of the toner in excess of 0.60 mg/cm$^2$.

4. The method as in claim 1, wherein the second layer has the lower thermal conductivity second toner particles and is uniformly applied over the first layer at a mass lay-down of the toner in excess of 1.0 mg/cm$^2$.

5. The method as in claim 1, wherein the second layer has the lower thermal conductivity second toner particles and is applied using an inverse mask such that regions of the hidden information have the mass laydown of the second layer in excess of 1.0 mg/cm$^2$.

6. The method as claim 1, wherein the first toner particles include individually or a combination of pigments and dyes.

7. The method as in claim 1, wherein the thermal conductivity of the first toner particles are in the range of 0.3 to 0.7 W/(m-° K) and the thermal conductivity of the second toner particles is less than or equal to 90% of the thermal conductivity of the first toner particles.

8. The method as in claim 1, wherein the thermal conductivity of the first toner particles are in the range of 0.3 to 0.7 W/(m-° K) and the thermal conductivity of the second toner particles is less than or equal to 70% of the thermal conductivity of the first toner particles.

9. The method as in claim 1, wherein the first layer has the lower thermal conductivity first toner particles, is non-uniformly applied over the substrate, and is removable in regions where the mass lay-down of the first toner layer is in excess of 1.0 mg/cm$^2$.

10. The method as in claim 1, wherein the thermal conductivity of the second toner particles are in the range of 0.3 to 0.7 W/(m-° K) and the thermal conductivity of the first toner particles is less than or equal to 90% of the thermal conductivity of the first toner particles.

11. The method as in claim 1, wherein the thermal conductivity of the second toner particles are in the range of 0.3 to 0.7 W/(m-° K) and the thermal conductivity of the first toner particles is less than or equal to 70% of the thermal conductivity of the first toner particles.

12. The method as in claim 1, wherein the heat is applied using two nip-forming rollers of which at least one is heated during one-pass through the two nip forming rollers.

13. The method as in claim 1, wherein a hard object is used to scratch off the regions of greater thickness of the first toner layer thereby creating the visible image.

14. The method as in claim 1, where the regions of greater thickness of the first toner layer are removed using an adhesive force thereby creating the visible image.

15. The method as in claim 1 further comprising the step of printing and fixing an indicia image on the substrate before applying the first toner layer;

wherein the regions of greater thickness are in registration with the printed indicia image.

16. The method as in claim 1, wherein the first toner particles or second toner particles include additives selected from the group consisting of air, calcium silicate, carbon, clay, diatomaceous earth, diatomite, foam glass, magnesia insulation, mica, nylon 6, paraffin wax, polypropylene, polystyrene, polystyrol, polyurethane foam, PTFE, PVC, rubber, sand, silicon aerogel, urethane foam, and vermiculite.

* * * * *